US008590499B2

(12) United States Patent
Ilgeroth et al.

(10) Patent No.: US 8,590,499 B2
(45) Date of Patent: Nov. 26, 2013

(54) CAMSHAFT MODULE FOR ATTACHMENT TO A CYLINDER HEAD OF AN INTERNAL COMBUSTION ENGINE

(75) Inventors: Mario Ilgeroth, Thale (DE); Andreas Freytag, Quedlinburg (DE); Alexander Langer, Wernigerode (DE); Henrik Wagner, Ilsenburg (DE); Stefan Retzlaff, Wernigerode (DE); Jorge Manuel Miranda Soares, Wettringen (DE); Norbert Schuling, Lohne (DE)

(73) Assignees: ThyssenKrupp Presta TecCenter AG, Eschen (LI); Polytec Plastics Germany GmbH & Co. KG, Lohne (DE)

( * ) Notice: Subject to any disclaimer, the term of this patent is extended or adjusted under 35 U.S.C. 154(b) by 594 days.

(21) Appl. No.: 12/865,662

(22) PCT Filed: Jan. 28, 2009

(86) PCT No.: PCT/EP2009/000533

§ 371 (c)(1),
(2), (4) Date: Oct. 19, 2010

(87) PCT Pub. No.: WO2009/095215

PCT Pub. Date: Aug. 6, 2009

(65) Prior Publication Data

US 2011/0041790 A1 Feb. 24, 2011

(30) Foreign Application Priority Data

Jan. 31, 2008 (DE) ..... 10 2008 007 091

(51) Int. Cl.
*F01L 1/02* (2006.01)

(52) U.S. Cl.
USPC ..... 123/90.27; 123/90.16; 123/90.31; 123/193.5; 123/195 C; 123/198 DA

(58) Field of Classification Search
USPC ..... 123/90.27, 90.16, 90.31, 193.3, 193.5, 123/198 DA, 195 C
See application file for complete search history.

(56) References Cited

U.S. PATENT DOCUMENTS

| | | | |
|---|---|---|---|
| 3,352,293 | A | 11/1967 | Hulten |
| 3,672,338 | A | 6/1972 | Yamanouchi |
| 4,821,693 | A | 4/1989 | Koller |
| 4,823,747 | A | 4/1989 | Wagner et al. |
| 2008/0295796 | A1 | 12/2008 | Dunsch et al. |

FOREIGN PATENT DOCUMENTS

| | | | |
|---|---|---|---|
| DE | 36 41 129 | C1 | 7/1987 |
| DE | 36 43 673 | A1 | 6/1988 |
| DE | 40 17 048 | A1 | 11/1991 |

(Continued)

OTHER PUBLICATIONS

International Search Report dated May 20, 2009 including English-language translation (Six (6) pages).

(Continued)

*Primary Examiner* — Ching Chang
(74) *Attorney, Agent, or Firm* — Crowell & Moring LLP

(57) ABSTRACT

A pre-assembled camshaft module for attachment to a cylinder head of an internal combustion engine includes a cylinder head cover, at least one camshaft, and bearing elements to which the camshaft is rotatably mounted. The bearing elements are formed as bearing brackets, which are connected by attachment members to the cylinder head cover at individual attachment points, in order to produce the pre-assembled camshaft module. The camshaft module is connectable to the cylinder head at the attachment points by the attachment members.

14 Claims, 4 Drawing Sheets

(56) References Cited

FOREIGN PATENT DOCUMENTS

| | | | |
|---|---|---|---|
| DE | 196 03 692 | A1 | 8/1997 |
| DE | 198 31 772 | A1 | 1/1999 |
| DE | 201 20 912 | U1 | 7/2002 |
| DE | 20 2006 018 359 | U1 | 3/2007 |
| EP | 1 998 034 | A2 | 12/2008 |

OTHER PUBLICATIONS

PCT/ISA/237 (Five (5) pages).

8
4
8
4
8
4
8
4
4
4
30
9
5
9
5
9
5

CAMSHAFT MODULE FOR ATTACHMENT TO A CYLINDER HEAD OF AN INTERNAL COMBUSTION ENGINE

BACKGROUND OF THE INVENTION

This application is a national stage of PCT International Application No. PCT/EP2009/000533, filed Jan. 28, 2009, which claims priority under 35 U.S.C. §119 to German Patent Application No. 10 2008 007 091.2, filed Jan. 31, 2008, the entire disclosure of which is herein expressly incorporated by reference.

The present invention relates to a pre-assembled camshaft module of the general type disclosed in German patent document DE 201 20 912 UI. In this known camshaft module a cylinder head cover is provided which has first bearing halves connected thereto as one piece for the camshaft bearings of a camshaft. In order to produce a pre-assembled camshaft module which can subsequently be screwed to the cylinder head, the camshafts are inserted into the first bearing halves which are integrally formed with the cylinder head cover and the second bearing halves are screwed on. In this way the individual components, cylinder head cover, camshaft and second bearing halves, are pre-assembled to form a module. This pre-assembled camshaft module or cylinder head cover module can then be mounted as a whole on the cylinder head.

A disadvantage of this known camshaft module is that the first bearing halves receiving the camshafts are integrally formed with the cylinder head cover. This means that the cylinder head cover cannot be formed, for example, from synthetic material but must consist of a material which is suitable for the bearing halves for mounting the camshaft and has sufficient strength. The cylinder head cover in accordance with German patent document DE 201 20 912 UI will thus consist of a suitable metal such as aluminum.

It is also disadvantageous that the bearing halves integrally formed with the cylinder head cover have to be worked by a complicated machining process in order to achieve the dimensions, tolerances and surface quality required for mounting the camshaft.

Furthermore, the process of pre-assembling the camshaft module and screwing it to the cylinder head of the internal combustion engine is comparatively complicated in the case of the camshaft module in German patent document DE 201 20 912 UI. Since the second bearing halves are screwed to the first bearing halves integrally formed with the cylinder head cover, the camshaft module pre-assembled in this way must be screwed to the cylinder head at separate attachment points, by separate screws. Two sets of attachment screws and two successive separate screwing processes are required, namely on the one hand the screwing process by which the second bearing halves are screwed to the first bearing halves, and on the other hand the screwing process by which the pre-assembled camshaft module is screwed to the cylinder head.

SUMMARY OF THE INVENTION

One object of the invention, therefore, is to provide a pre-assembled camshaft module that may be quickly and simply pre-assembled and attached to the cylinder head, and requires the smallest possible number of attachment means. Furthermore, it should be possible to use a cylinder head cover which is made of synthetic material.

This and other objects and advantages are achieved by the camshaft module according to the invention, in which provision is made for the camshaft to be received in a rotatably mounted manner in separate bearing brackets, and for these bearing brackets to be connected to each other via an attachment means at individual points of attachment to the cylinder head cover. At the same time the camshaft module is firmly connected to the cylinder head of the internal combustion engine at the said attachment points via the same said attachment means. The attachment means can be formed as screws. In this way only one set of screws is required to pre-assemble the camshaft module and then to screw it firmly to the cylinder head.

If the camshaft module has, for example, two camshafts, the bearing brackets can be formed as individual bearing brackets or even as so-called double bearing brackets. If they are formed as individual bearing brackets then the individual bearing brackets can be formed in such a way that they ca be connected to each other.

In each embodiment of the invention the bearing brackets can be formed as divided or as closed (one-piece) bearing brackets.

By means of the individual screws the cylinder head cover and the bearing brackets receiving the camshaft are held together so that a pre-assembled camshaft module is provided. The camshaft module pre-assembled in this way is then placed onto the cylinder head and attached to the cylinder head using the same attachment means (for example, the same screws) which serve to pre-assemble the camshaft module.

In an advantageous manner, one or more plug connections can also be provided to produce the pre-assembled camshaft module, which plug connections can connect the bearing brackets receiving the camshafts; i.e., they can be fitted together, with the cylinder head cover. In this case the bearing brackets together with the camshaft are first simply fitted together with the cylinder head cover and thereby held together in a non-positive manner, a positive manner or a non-positive and positive manner. This fitting-together constitutes a temporary assembly of the camshaft module. The screws are then put into place in order to produce the fully pre-assembled camshaft module. If the attachment means are formed as screws, the screws are preferably inserted or screwed in through through-bores in the bearing brackets so that they connect the bearing brackets and the camshafts mounted in the bearing brackets to the cylinder head cover.

The camshaft module pre-assembled in this way is then subsequently screwed to the cylinder head by means of the same screws. This mounting of the camshaft module on the cylinder head of the engine generally takes place only on the vehicle manufacturer's assembly line for mounting the individual engine components. With the camshaft module in accordance with the invention the supplier of the module to the vehicle manufacturer can therefore provide a module which can be delivered ready for installation to the vehicle manufacturer's assembly line. The screws required for mounting the module on the cylinder head are already provided and integrated into the pre-assembled module. It is therefore not necessary for the vehicle manufacturer for his part to stock screws required for the attachment of the module to the cylinder head and to provide them on the assembly line.

A further advantage of the invention is that the camshaft module in accordance with the invention can be dismantled in such a way that the cylinder head cover can be taken off without the camshafts having to be removed with it. The camshafts are therefore freely accessible, for example, for after-sales service. This is an important advantage over the camshaft module in German patent document DE 201 20 912 UI, in which, due to the bearing halves which are integrally formed with the cylinder head cover, the cylinder head cover cannot be taken off separately from the camshafts.

The solution in accordance with the invention permits the use of both divided and non-divided bearing brackets. Non-divided bearing brackets must be pushed onto the shaft body of the camshaft during assembly of the camshaft. In contrast to this, divided bearing brackets can also be mounted on the camshaft after the camshaft is assembled. In particular, the present invention permits the production of small bearing diameters; that is, bearing brackets can be used that have an outer diameter which is smaller than the radial extension of the cams of the camshaft. In this way large bearing diameters which involve greater friction than small bearing diameters can be avoided.

In accordance with an advantageous embodiment of the invention one or more plug connections can be provided, by which the cylinder head cover and the bearing brackets receiving the camshaft can be connected to each other. After the plug connections are fitted together the cylinder head cover and the bearing brackets are connected to each other in a non-positive manner, a positive manner or a non-positive and positive manner. The components pre-attached in this manner can then be connected to each other in such a way by screwing in or inserting the screws that the screws hold together the individual module components.

Receiving sleeves are preferably provided on the bearing brackets at the sites of the attachment points and can have an internal thread into which the screws can be screwed. However, the receiving sleeves do not have to have an internal thread. It will be sufficient to provide only a single thread turn in the receiving sleeve so that the screw can be tightened sufficiently to hold the module components together. It would also be feasible instead of a thread or a single thread turn to dimension the bores of the receiving sleeves in such a way by the selection of suitable tolerances that the screws are just inserted and hold together the module components in a non-positive and/or positive manner. In accordance with the invention it is only a matter of the two assemblies of the camshaft module, namely the cylinder head cover and the camshaft(s) with the bearing brackets being held together in the preassembled state in such a way that they can be delivered to the client's assembly line for cylinder head mounting, and can there be attached to the cylinder head using the same attachment means as are used to hold the camshaft module together.

If provision is made for the module components to be connected to each other by means of a plug connection before placement of the screws, the receiving sleeves can serve as mating parts of such a plug connection and can be used for this purpose. The cylinder head cover has apertures at the attachment points, through which the receiving sleeves engage. The plug connection between the cylinder head cover and the bearing brackets can easily be produced between the apertures and the receiving sleeves.

At the attachment points, elastomeric rings which are disposed concentric to the receiving sleeve can be provided between the receiving sleeve and the aperture allocated to the respective receiving sleeve in the cylinder head cover. These elastomeric rings acoustically decouple the cylinder head cover from the bearing brackets and the cylinder head of the engine. The elastomeric rings prevent sound waves from being transferred to the cylinder head cover so that no undesired noises such as a droning noise are produced or propagated via the cylinder head cover.

In the camshaft module in accordance with the invention the cylinder head cover advantageously consists of synthetic material. On the one hand it is thereby possible to make weight savings in comparison to cylinder head covers consisting of aluminum or other metals. On the other hand the use of cylinder head covers made from synthetic material also offers acoustic advantages with respect to those made of metal because, in the case of synthetic material cylinder head covers, structure-borne sound waves issuing from the cylinder head are damped more successfully than in the case of metal cylinder head covers.

The invention can be applied in a particularly advantageous manner in the case of engines with a number of camshafts. Thus, for example, for engines in which two camshafts are provided, camshaft modules with two mutually parallel camshafts can be used. In accordance with the invention in the case of such camshaft modules each camshaft is rotatably received by means of a plurality of bearing brackets, wherein in each case two bearing brackets of each camshaft are disposed next to each other and aligned with each other in a plane which extends transversely to the longitudinal axis of the camshafts. Each pair of adjacent mutually aligned bearing brackets can advantageously be connected to the cylinder head cover via only three attachment points. In this way the camshaft module is also screwed to the cylinder head at these three attachment points. In comparison to solutions in which individual bearing shell halves are formed integrated into the cylinder head cover, by means of this solution in accordance with the invention one attachment point and therefore also one screw is spared per bearing bracket pair.

It is particularly advantageous if two adjacent mutually aligned bearing brackets of each camshaft overlap with each other in the region between the two camshafts and have a common attachment point in the overlapping region. In this way the two bearing brackets of the bearing bracket pair can be connected to the cylinder head via only three attachment points without any detriment to the quality of the attachment.

Other objects, advantages and novel features of the present invention will become apparent from the following detailed description of the invention when considered in conjunction with the accompanying drawings.

BRIEF DESCRIPTION OF THE DRAWINGS

FIG. 1*b* is an exploded view of the camshaft module in accordance with FIG. 1*a;*

DETAILED DESCRIPTION OF THE INVENTION

Figure 1A:
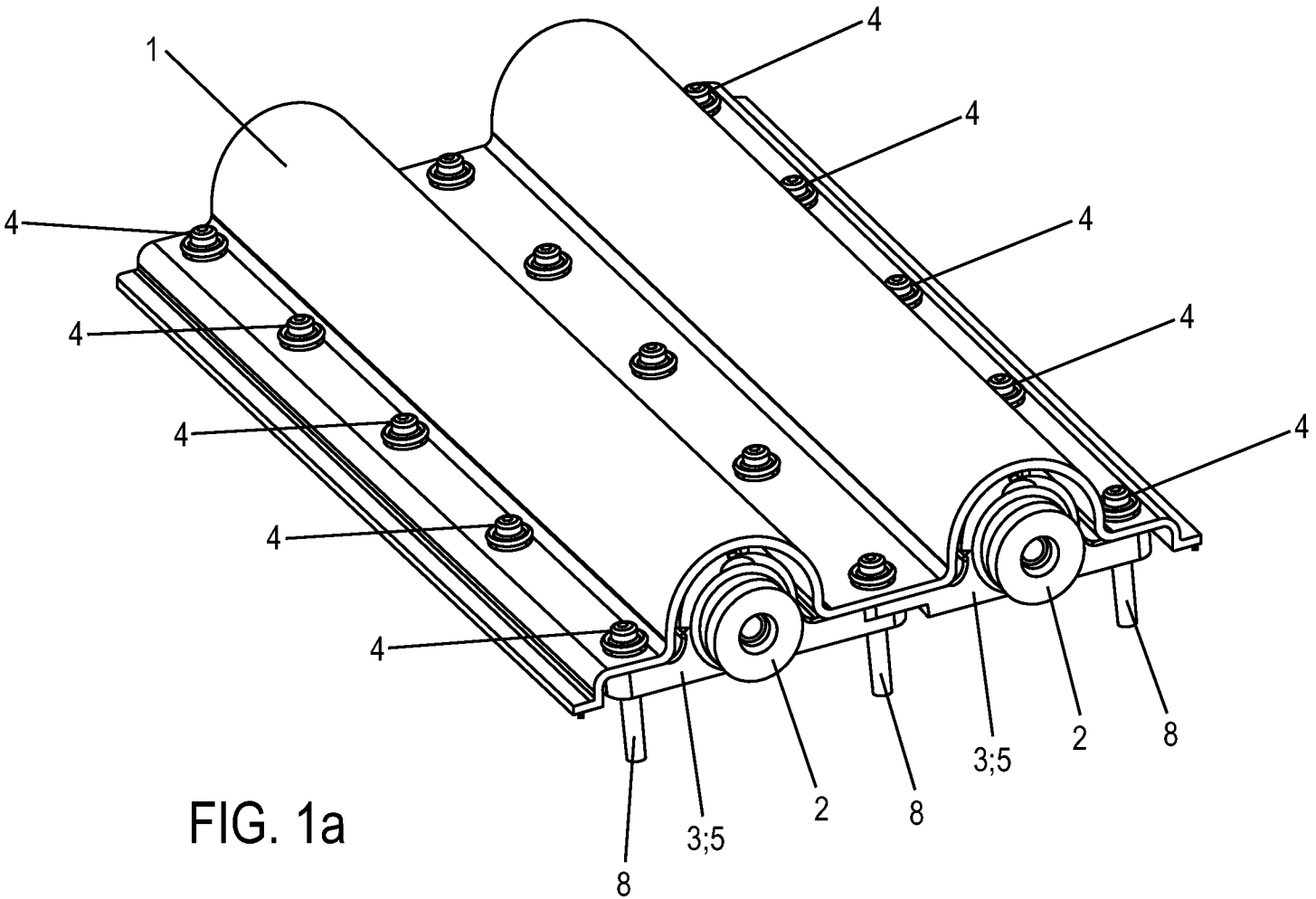
FIG. 1*a* is a perspective view of the pre-assembled camshaft module in accordance with the invention.

FIG. 1*a* shows a perspective view of the camshaft module in accordance with the invention in the pre-assembled state. The cylinder cover 1 is held together with the bearing brackets 5 by means of screws 8. The bearing brackets 5 receive the camshafts 2 in a rotatably mounted manner. The bearing brackets 5 are designed as bearing elements formed completely separate from the cylinder head cover 1. The bearing brackets 5 are connected to the cylinder head cover 1 at individual attachment points 4 via the screws 8.

In total, 15 attachment points 4 are provided at which the cylinder head cover 1 is connected to the bearing brackets 5 by means of the screws 8. In FIG. 1*a* for the sake of greater clarity only the outer rows of the attachment points 4 are designated by reference numerals. The row of attachment points 4 disposed between the two camshafts 2 is not designated by reference numerals. At these undesignated attachment points 4 which are disposed in the region between the two camshafts 2 the two mutually adjacent bearing brackets 5 of the respective camshaft are respectively connected to each other via a common screw 8. The mutually adjacent bearing brackets 5 of the camshafts 2 have an overlapping region in the region between the two camshafts, in which the two bearing brackets overlap. The middle row of screws 8 in FIG. 1*a* therefore passes through both mutually adjacent bearing brackets 5 in the overlapping region so that in this overlapping region both bearing brackets are connected to the cylinder head cover 1 by a single screw.

Instead of individual mutually overlapping bearing brackets 5 it would also be possible to use a single-piece double bearing bracket in contrast to the exemplified embodiment illustrated in FIG. 1*a*. In this case there would be no overlapping region as in the illustrated exemplified embodiment, but the two bearing orifices receiving the camshafts would be connected to each other as one piece via a connecting region. In this connecting region a bore could then be provided for passage of the screws 8, however, it would also be possible to dispense with the screws 8 in the connecting region entirely and to connect the double bearing brackets to the cylinder head cover 1 only by means of the respective outwardly disposed screws 8 in FIG. 1*a*.

However, the screws 8 disposed at the attachment points 4 not only serve to hold the assembly, formed from camshaft 2 and bearing brackets 5, together with the cylinder head cover 1 but they can also serve to attach the camshaft module to the cylinder head. The camshaft module shown in FIG. 1*a* can be supplied to the vehicle manufacturer by the automobile supplier as a completely pre-assembled module, and this camshaft module can then be screwed, just as it is, to the cylinder head of the internal combustion engine directly on the assembly line. It is not necessary for the vehicle manufacturer to keep separate attachment screws for mounting the camshaft module ready at the mounting workplace. The mounting of the camshaft module in accordance with the invention on the cylinder head is thereby simplified with respect to the known camshaft modules, for example the camshaft module in German patent document DE 201 20 912 U1.

In the camshaft module in accordance with the invention as shown in FIG. 1*a*, the cylinder head cover 1 is formed from synthetic material. This is readily possible because the bearing brackets 5 rotatably mounting the camshafts 2 are designed as bearing elements formed entirely separately from the cylinder head cover. The bearing brackets 5 are preferably made from metal.

In FIG. 1*b* the camshaft module of FIG. 1*a* is shown in an exploded view. This illustration aids understanding of the structure of the camshaft module. It can be clearly seen that the bearing brackets 5 and the cylinder head cover 1 form mutually separate components which can be connected to each other via the screws 8 to form a pre-assembled camshaft module. It can also be clearly seen how the overlapping region is formed, in which two mutually adjacent bearing brackets 5 overlap. For this purpose a recess 5*a* and 5*b* is provided in each bearing bracket 5. These recesses 5*a*, 5*b* are dimensioned such that in the assembled state the recesses 5*a*, 5*b* complement each other to form a full material thickness of the bearing bracket.

In the illustration shown in FIG. 1*b* it is particularly clear that the bearing brackets 5 have receiving sleeves 9 for receiving the screws 8 at the attachment points 4. In the illustrated exemplified embodiment the receiving sleeves 9 are provided with an internal thread so that the screws 8 can be screwed into the receiving sleeves 9. However, it would also be fundamentally feasible to dispense with an internal thread in the receiving sleeves 9 and merely to insert the screws 8 into the receiving sleeves 9. In this case the screws would form a non-positive and/or positive connection between the assembly of the camshafts 2 with bearing brackets 5 and cylinder head cover 1. Between the cylinder head cover 1 and the bearing brackets 5 sealing rings 20 are disposed which surround the receiving sleeves 9. These sealing rings 20 serve for acoustic decoupling of the cylinder head cover 1 because the sealing rings 20 prevent the formation of a sound bridge between the cylinder head cover 1 and cylinder head.

Furthermore, FIG. 1*b* shows a peripheral seal 30 which ensures sealing tightness with respect to the cylinder head when the camshaft module is in the mounted state.

Figure 1C:
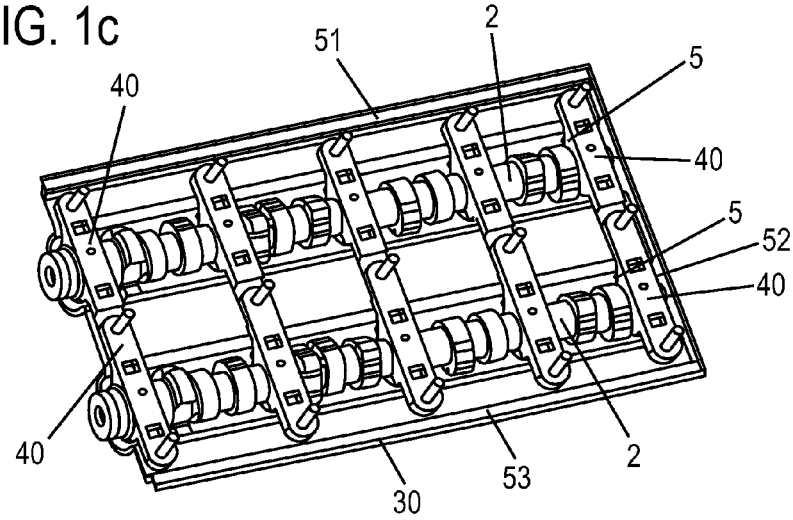
FIG. 1*c* is a perspective view of the pre-assembled camshaft module in accordance with FIG. 1*a* seen from below, i.e. from the cylinder head of the engine.
Figure 1C:
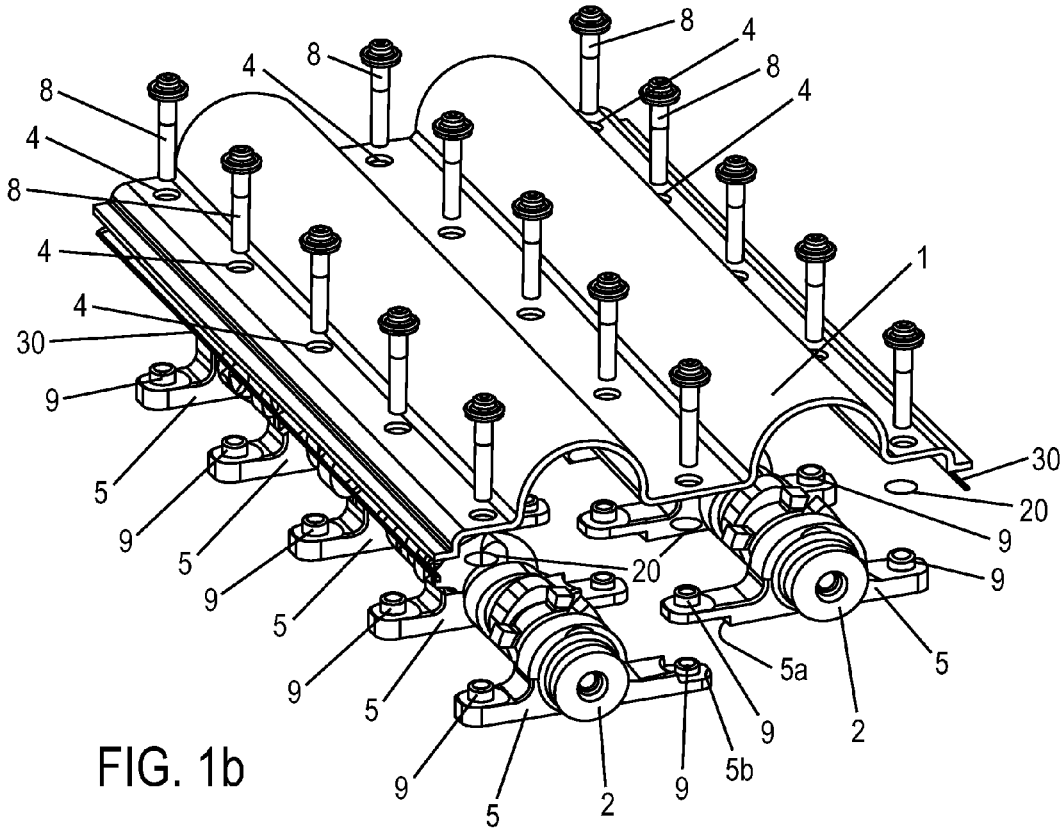

FIG. 1*c* is a perspective view of the camshaft module in accordance with FIG. 1*a* in the pre-assembled state. This view shows that the bearing brackets 5 connected to the cylinder head cover 1 have a planar mounting surface 40. These planar mounting surfaces 40 are supported on corresponding counter surfaces of the cylinder head when the camshaft module is screwed to the cylinder head. The cylinder head cover 1 has flanges 51, 52, 53 to which the seal 30 is attached. These flanges 51, 52, 53 are supported on corresponding counter surfaces of the cylinder head when the camshaft module is mounted, and the seal 30 seals with respect to the outside the space enclosed between the cylinder head and the cylinder head cover 1. The flanges 51, 52, 53 therefore form contact surfaces of the cylinder head cover 1, with which this is in contact with the cylinder head (not shown) when in the mounted state.

Figure 2:
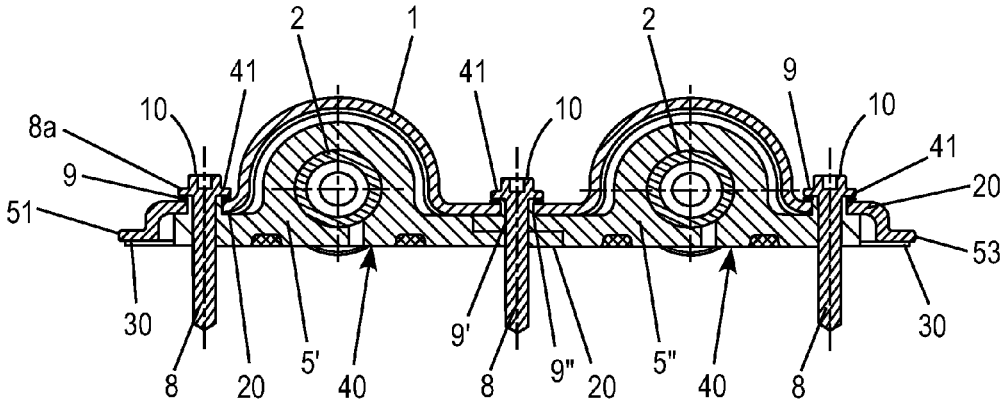
FIG. 2 is a cross-sectional view through a mutually adjacent bearing bracket pair of the camshaft module in accordance with FIG. 1*a;*

FIG. 2 shows a cross-sectional view through two mutually adjacent bearing brackets 5 of the camshaft module in accordance with FIG. 1*a*. The two mutually adjacent bearing brackets 5 are aligned with each other in a plane directed transverse to the longitudinal axis of the camshafts 2. Each camshaft module receives a camshaft 2 in a rotatably mounted manner. The cylinder head cover 1 has apertures 10 which receive the receiving sleeves 9 of the bearing brackets 5. The receiving sleeves 9 have internal threads into which the screws 8 are screwed. In this way the assembly formed by the bearing brackets 5 and camshafts 2 is held together with the cylinder head cover 1. Between the cylinder head cover 1 and the bearing brackets 5, sealing rings 20 are disposed through which the cylinder head cover 1 is acoustically decoupled from the bearing brackets 5 and therefore from the cylinder head. This cross-sectional illustration of FIG. 2 clearly shows that the screws 8 have a collar 8*a*, and that between the collar 8*a* of the screws 8 and the cylinder head cover 1 a sealing ring 41 is disposed. This sealing ring 41 serves to seal with respect to the environment the inner space enclosed by the cylinder head cover 1.

FIG. 2 also clearly shows how the overlapping of the bearing brackets 5', 5" in the overlapping region between the two camshafts 2 is constructed. Both bearing brackets 5', 5" have receiving sleeves 9, 9', 9" which are formed as one piece with the bearing brackets 5', 5". The receiving sleeve 9' of the bearing bracket 5' shown on the left in FIG. 2 engages in an aperture in the overlapping region of the bearing bracket 5" shown on the right in FIG. 2. Together with the receiving sleeve 9" of the bearing bracket 5" shown on the right in FIG. 2 the two receiving sleeves 9', 9" form a common receiving sleeve for the screw 8. The receiving sleeve 9' of the bearing bracket 5' shown on the left in FIG. 2 serves at the same time as a centring means through which the two bearing brackets 5', 5" are aligned with respect to each other in the assembled position.

The lateral flanges 51 and 53 are also clearly shown in the illustration in FIG. 2. They support 20 the seal 30 which serves to seal with respect to the environment the inner space enclosed by the cylinder head cover 1 and the cylinder head, not shown.

As shown in FIG. 2 the bearing brackets 5 have planar mounting surfaces 40 which are supported on corresponding counter surfaces of the cylinder head, not shown, when the camshaft module is attached to the cylinder head. In order to attach the camshaft module to the cylinder head it is only necessary to screw the screws 8 into corresponding threaded bores in the cylinder head. Additional attachment screws are not necessary.

Figure 3:
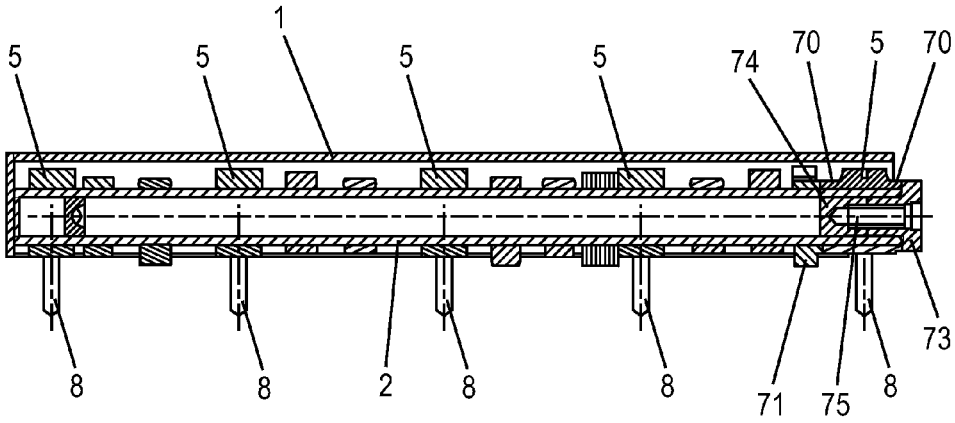
FIG. 3 is a longitudinal cross-sectional view through a camshaft of the camshaft module in accordance with FIG. 1*a;*

FIG. 3 shows a longitudinal cross-sectional view through a camshaft 2 in accordance with FIG. 1*a* and FIG. 2. In the illustrated exemplified embodiment the camshaft is formed with a tubular shaft body. Of course, within the scope of the invention, however, a camshaft can also be used which is formed as a solid shaft. This illustration in FIG. 3 again shows the screws 8 which are disposed spatially behind the camshaft 2 and which are screwed into the receiving sleeves 9 (not visible) of the bearing brackets 5. The bearing bracket 5 shown on the far outside right in FIG. 3 has protrusions 70 extending in the longitudinal direction of the camshaft 2. The protrusions 70 are clamped in between a camshaft component 71, which is attached to the camshaft 2, and the radial collar 73 of a closure stopper 74 which is pressed into the tubular shaft body of the camshaft 2. The closure stopper 74 has a central threaded bore 75 into which a closure element or drive element, not shown, can be screwed.

Figure 4:
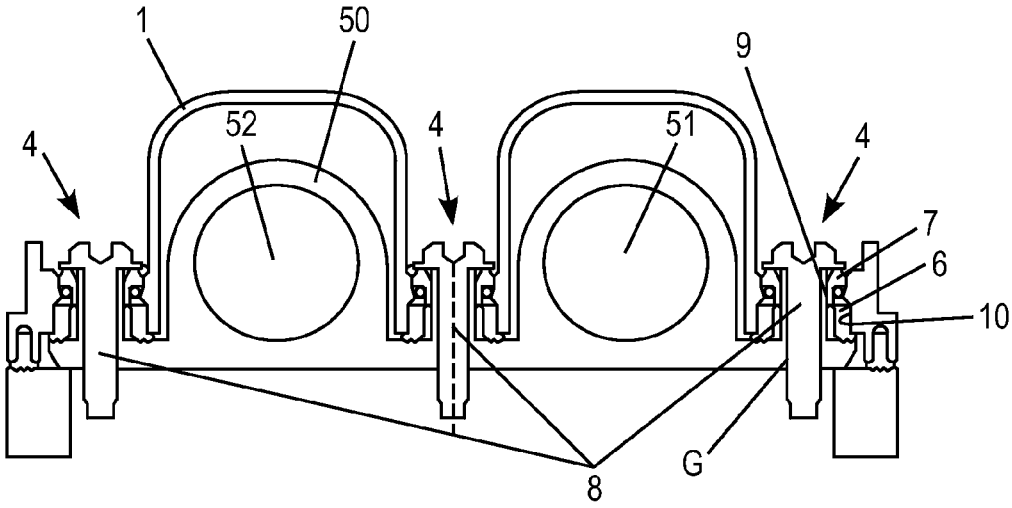
FIG. 4 is a cross-sectional view through a camshaft module in a design for two parallel camshafts and with a double bearing bracket and elastomeric rings which are disposed between the receiving sleeve and the cylinder head cover.

FIG. 4 shows a cross-sectional view through a camshaft module in accordance with the invention in an embodiment for two parallel camshafts, wherein elastomeric rings 6, 7 are disposed between the receiving sleeves 9 and the apertures 10 provided in the cylinder head cover 1. These elastomeric rings effect an acoustic decoupling of the cylinder head cover from the bearing brackets and the cylinder head of the engine. Furthermore, the bearing bracket 50 is formed in this embodiment of the invention as a single-piece double bearing bracket which has two bearing orifices 51, 52. These bearing orifices 51, 52 are connected to each other via a connecting region. In the connecting region an attachment point 4 is provided which is formed analogously to the two outer attachment points 4. At the attachment point 4 on the right in FIG. 4 a single thread turn G is shown by way of example, by means of which the pre-assembly of the camshaft module can be effected by screwing in the screws 8. Thread turns of this type are also provided at the other attachment points but are not illustrated in FIG. 4 in order to obtain a clearer view.

Figure 5A:
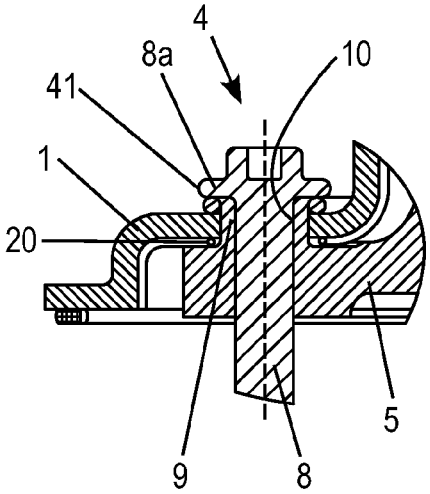
FIG. 5*a* is an enlarged view of an external attachment point of the camshaft module in accordance with FIG. 1*a;*

FIG. 5*a* shows an enlarged view of an attachment point 4 disposed on the outside in FIG. 1*a*. In this embodiment no elastomeric rings are disposed between the receiving sleeve 9 of the bearing bracket 5 and the cylinder head cover 1 but the receiving sleeve 9 serves directly as a "centring pin" which fits precisely into the aperture 10 in the cylinder head cover 1. The sealing ring 20, which is disposed between the bearing bracket 5 and the cylinder head cover 1, and the sealing ring 41, which is disposed between the cylinder head cover 1 and the collar 8*a* of the screw 8 are also clearly shown.

Figure 5B:
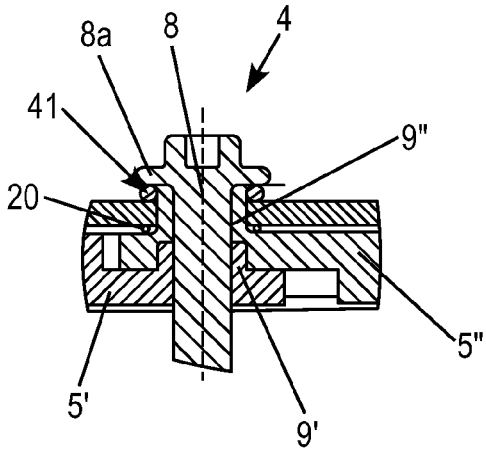
FIG. 5*b* is an enlarged view of an attachment point of the camshaft module in accordance with FIG. 1*a*, which is disposed in the overlapping region of two adjacent bearing brackets.

FIG. 5*b* shows an enlarged view of an attachment point in the overlapping region of two mutually adjacent bearing brackets 5', 5". The bearing bracket 5' has a receiving sleeve 9' which engages into an aperture in the bearing bracket 5". The bearing bracket 5" for its part also has a receiving sleeve 9" which is directed coaxial to the receiving sleeve 9'. The two partial receiving sleeves 9', 9" complement each other to form a receiving sleeve 9 receiving the screw 8.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A pre-assembled camshaft module for attachment to a cylinder head of an internal combustion engine, said camshaft module comprising:

a cylinder head cover;

at least one camshaft; and bearing elements to which said camshaft is rotatably mounted; wherein, the bearing elements are connectable to the cylinder head cover at individual attachment points;

the bearing elements are formed as bearing brackets which are connected to the cylinder head cover at the attachment points by attachment members in order to produce the pre-assembled camshaft module;

the camshaft module is connectable to the cylinder head at said attachment points by said attachment members;

at least two camshafts are provided which are aligned in parallel with each other;

each camshaft is rotatably received by a plurality of bearing brackets;

each two bearing brackets of each camshaft are disposed next to each other and aligned with each other in a plane which extends transversely to the longitudinal axis of the camshafts; and each two adjacent mutually aligned bearing brackets are connected to the cylinder head cover via only three attachment points.

2. The camshaft module as claimed in claim 1, wherein the attachment members comprise screws.

3. The camshaft module as claimed in claim 2, wherein the cylinder head cover and the bearing brackets receiving the camshaft are held together by the screws in an uninstalled state of the camshaft module.

4. The camshaft module as claimed in claim 3, wherein the cylinder head cover and the bearing brackets receiving the camshaft are connectable by at least one plug connection in a manner that is one of positive or non-positive and positive, before the screws are put in place.

5. The camshaft module as claimed in claim 2, wherein at the attachment points the bearing brackets have receiving sleeves with an internal thread into which the screws can be screwed.

6. The camshaft module as claimed in claim 5, wherein at the attachment points the cylinder head cover has apertures through which the receiving sleeves engage.

7. The camshaft module as claimed in claim 6, wherein at the attachment points between the receiving sleeve and the aperture elastomeric rings are provided which are concentric to the receiving sleeve.

8. The camshaft module as claimed in claim 1, wherein the cylinder head cover is made of a synthetic material.

9. The camshaft module as claimed in claim 1, wherein each two adjacent mutually aligned bearing brackets overlap each other in a region between the two camshafts and have a common attachment point in the overlapping region.

10. The camshaft module as claimed in claim 9, wherein:

in the overlapping region a first bearing bracket has a first receiving sleeve and a second bearing bracket has a second receiving sleeve; and the first receiving sleeve engages in an aperture in the second bearing bracket such that the two receiving sleeves are disposed coaxially with each other and form a common receiving sleeve.

11. The camshaft module as claimed in claim 1, wherein the camshafts are rotatably received in bearing orifices of multiple bearing brackets.

12. The camshaft module as claimed in claim 11, wherein the multiple bearing brackets are formed as one piece so that the bearing orifices are connected to each other via a connecting region.

13. The camshaft module as claimed in claim 11, wherein exactly two camshafts are provided which are rotatably received in the respective bearing orifices of double bearing brackets.

14. The camshaft module as claimed in claim 13, wherein the double bearing brackets are connected to the cylinder head cover only at their outsides via the attachment member.

* * * * *